United States Patent [19]

Maurer

[11] 4,003,582

[45] Jan. 18, 1977

[54] SKATE BOARD WHEEL BRAKE ASSEMBLY

[76] Inventor: Jeffrey A. Maurer, 3100 Cavendish Drive, Los Angeles, Calif. 90064

[22] Filed: Nov. 13, 1975

[21] Appl. No.: 631,713

[52] U.S. Cl. ..... 280/11.2; 188/2 R; 188/29; 280/87.04 A

[51] Int. Cl.[2] ..... A63C 17/14

[58] Field of Search ..... 280/11.2, 11.21, 11.19, 280/87.04 A; 188/29, 2 R

[56] References Cited

UNITED STATES PATENTS

| | | | |
|---|---|---|---|
| 182,835 | 10/1876 | Lockwood | 280/11.2 |
| 321,261 | 6/1885 | Turnbull | 280/11.2 |
| 2,027,487 | 1/1936 | Means | 280/11.2 |
| 3,288,251 | 11/1966 | Sakwa | 280/11.2 X |

*Primary Examiner*—Philip Goodman
*Assistant Examiner*—Milton L. Smith
*Attorney, Agent, or Firm*—Poms, Smith, Lande & Glenny

[57] ABSTRACT

A skate board wheel brake assembly is shown having a foot activated, resilient brake arm secured near the rear end of a skate board with the arm having a first portion having brake shoes thereon and formed to be in close proximity to the rear wheels of the skate board and a second extended portion having a brake depressor formed at the end thereof, so that downward pressure by the user on the brake depressor causes the brake shoe to apply braking force to the rear wheels of the assembly. In one embodiment, the skate board wheel brake assembly may be mounted to a skate board having conventional wheels mounted thereon. In a second embodiment, the skate board wheel brake assembly includes the rear wheels and is attached to the rear end of a conventional skate board. In a third embodiment, the brake assembly is molded to be integral with the skate board.

3 Claims, 6 Drawing Figures

SKATE BOARD WHEEL BRAKE ASSEMBLY

BACKGROUND OF THE INVENTION

The popularity of the skate boards as amusement and recreational devices has caused various safety hazards in their usage. Skate boards typically are formed of a flat elongated surface having two roller skate type wheel assemblies each at opposite ends. The movement of the skate board by the user is typically achieved by gravitational forces such as rolling down a hill. This forward movement of the skate board is hazardous if the hill is steep and the user develops an excessively high speed. Furthermore, turns using a skate board may be hazardous when the speed is excessively high.

The attainment of an excessively high speed using typiccal prior art skate boards is hazardous in that the user may fall off or be required to jump off at a high speed to stop the skate board. The user may attempt to reduce the speed of the skate board by dragging a foot alongside or behind the skate board. This method of reducing the speed is also hazardous, since it can cause the user to fall off the skate board at high speeds.

It has therefore become necessary to provide a braking device for such skate boards. Such a braking device is particularly useful for less qualified users.

SUMMARY OF THE INVENTION

The present invention provides a wheel brake assembly for a skate board having a foot activated, resilient brake arm mounted at the bottom rear portion of the skate board. The brake arm has a first portion having brake shoes secured to it and positioned to be in close proximity to the rear wheels of the skate board. The brake arm has a second extended portion having a brake depressor formed at the end thereof so that the user may exert downward pressure on the brake depressor to cause the brake shoe to apply braking force to the rear wheels of the assembly. The brake shoe may be any suitable gripping surface, such as a corrugated layer of plastic material.

In one embodiment, the brake assembly may be mounted to a skate board having conventional wheels. The brake assembly is formed of a resilient material, such as spring steel, and is secured to the rear of the skate board on the bottom thereof by suitable screws. The brake shoes are secured to the first portion of the brake arm adjacent the rear wheels and the braking action may be achieved by simply depressing the brake depressor at the end of the second portion.

In a second embodiment, the skate board wheel brake assembly includes the two rear wheels of the skate board and the asembly is attached, by means of screw holes, to the rear end of a conventional skate board. The assembly includes a brake arm formed of a suitable resilient material such as spring steel having a first portion having the brake shoes secured thereto and a second portion having a brake depressor mounted or formed at the end thereof. The user may apply braking force by applying downward pressure on the brake depressor with his rearward foot to thereby bend the resilient spring steel until the brake shoes come into contact with the wheels. The speed of the skate board may thereby be reduced and the skate board may be stopped. The brake, of course, may be released by removing pressure from the brake depressor.

In a third embodiment, the brake assembly may be molded to be integral with the skate board and the brake arm is formed of the same resilient plastic which constitutes the skate board surface. In this embodiment the brake arm has the two portions molded to be integral with the skate board.

The brake shoes may be formed of a material having a hardness that is equal to or less than the hardness of the wheels to enable the brake shoes to wear out without wearing out the wheels. The brake shoes are preferably adapted to be snapped on to the brake arm to be easily replaced. The simple construction of the invention and the resiliency of the brake arm in particular renders the invention less susceptible to wear and tear. The securing of the brake arm to the bottom rear portion renders the device unobtrusive in the normal operation of the skate board.

Accordingly, an object of the present invention is to provide a skate board wheel brake assembly which may be used in riding areas previously considered too dangerous for skate board use.

Another object is to provide a braking assembly for a skate board having a braking arm attached to the rear end of a conventional skate board.

Still another object is to provide braking means for a skate board having a wheel brake assembly including the two rear wheels of a skate board.

Yet another object is to provide a braking assembly for a skate board having a braking arm to be molded to be integral with the skate board.

Yet a further object of the present invention is to provide braking means for a skate board to increase the safety and maneuverability of the operation of the skate board without impeding the normal operation of the wheels.

Other objects, advantages, and novel features of the present invention will become apparent from the following detailed description of the invention when considered in conjunction with the accompanying drawings.

BRIEF DESCIPTION OF THE DRAWINGS

DESCRIPTION OF THE PREFERRED EMBODIMENT

Figure 1:
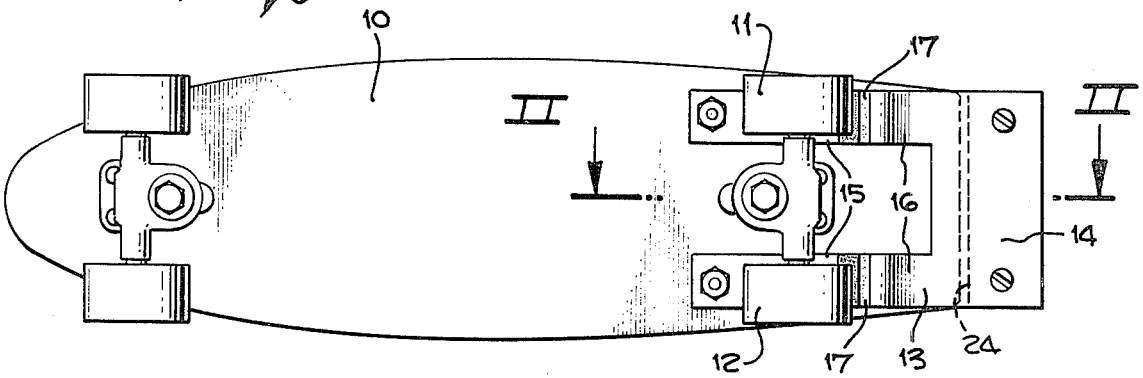
FIG. 1 is a bottom view of an embodiment of the present invention wherein the brake assembly is mounted to the rear of a conventional skate board.
Figure 2:
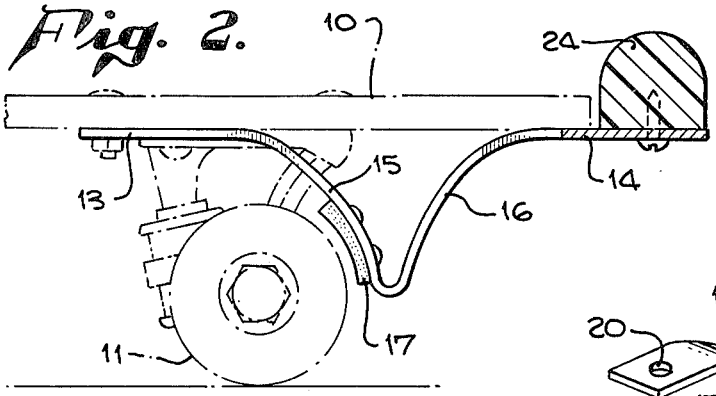
FIG. 2 is a sectional view of FIG. 1 taken along the plane II—II of FIG. 1.
Figure 3:
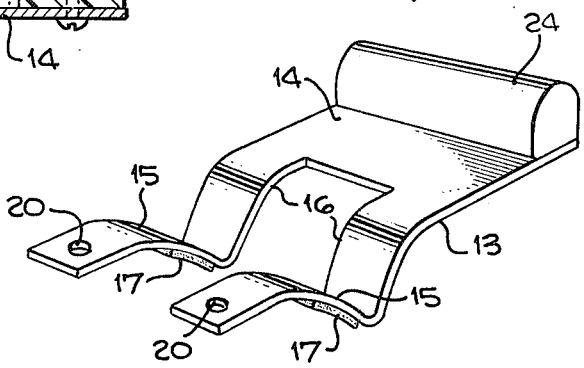
FIG. 3 is a perspective view of the embodiment of the present invention shown in FIG. 1.

Referring now to FIG. 1, there is shown the skate board wheel brake assembly of the present invention mounted on a conventional skate board 10, having rear wheels 11 and 12. The resilient brake arm 13 as shown in FIGS. 1, 2 and 3 has a first portion 15 and a second extended portion 16 with a foot activated brake depressor 14 formed at the end of the second extended portion 16 with a protruding portion 24 as shown. Brake shoes 17 are mounted on the first portion 15 to be in close proximity to the rear wheels 11 and 12 as shown in FIGS. 2 and 3.

The brake assembly may be attached to the skate board 10 by screws mounted through screw holes 20 as shown. The brake shoe may be formed in this and the other embodiments of the invention of a replaceable piece of plastic which is slightly softer than the material which constitutes the wheels 11 and 12 to thereby enable the brake shoes to wear out without causing the wheels to wear out. Alternatively, the brake shoes may be formed of a material having a hardness equal to the hardness of the rear wheels. Thus, the hardness of the brake shoes is equal to or less than the hardness of the wheels and therefore the brake shoes do not wear out the wheels.

The user may apply braking force to the skate board by simply depressing the foot activated brake depressor 14 at the protruding portion 24 to thereby cause the brake shoes 17 to urge against the wheels 11 and 12. The speed of the skate board may thereby be reduced and, if desired, the skate board may be brought to a halt.

Figure 4:
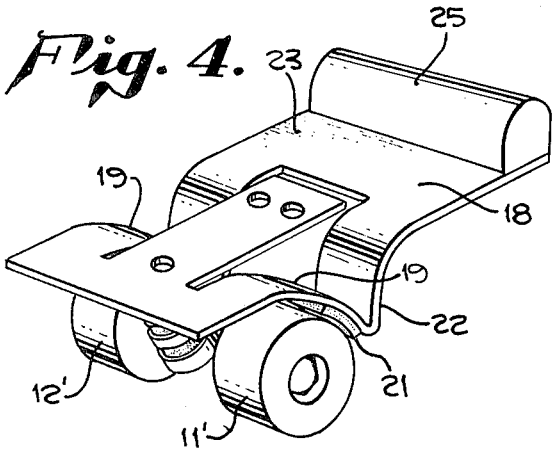
FIG. 4 is a perspective view of an embodiment of the present invention in which the wheel brake assembly includes the rear wheels.

In the embodiment shown in FIG. 4, the brake assembly includes the rear wheels 11 and 12 and the brake arm 18 is formed of a suitable resilient material such as spring steel. The first portion 19 of the brake arm 18 has brake shoes 21 mounted thereto in close proximity to the rear wheels 11' and 12'. The second portion 22 has a foot activated brake depressor 23 formed or secured at the end thereof with a protruding portion 25 as shown in FIG. 4. The braking pressure may be applied by simply depressing protruding portion 25 to cause the brake depressor 23 to activate the first portion 19 to urge the brake shoes 21 against the rear wheels to thereby reduce the speed of the skate board or enable the skate board to be brought to a halt.

Figure 5:
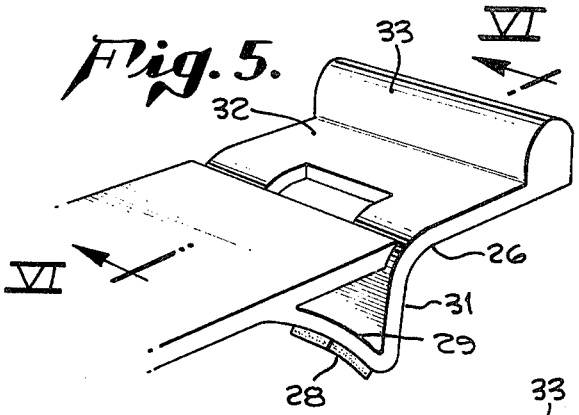
FIG. 5 is a perspective view of the embodiment of the present invention wherein the brake assembly is molded to be integral with the skate board.
Figure 6:
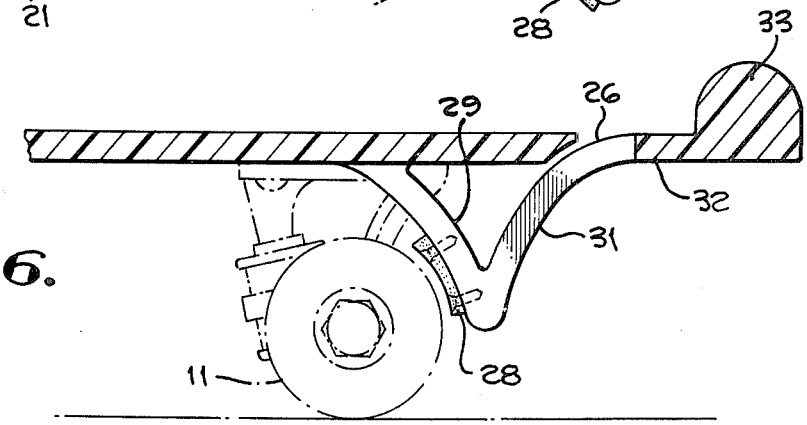
FIG. 6 is a sectional view of FIG. 5 taken along the plane VI—VI.

In the embodiment shown in FIGS. 5 and 6, the skate board wheel brake assembly includes a resilient brake arm 26 which is molded to be integral with the skate board. Brake shoes 28 are mounted on the first portion 29 of the brake arm 26 in close proximity of the rear wheel of the skate board as shown in FIG. 6. The second portion 31 of the brake arm 26 has a brake depressor 32 having a protruding portion 33 mounted or formed at the end thereof as shown in FIG. 6.

The skate board wheel brake assembly thereby enables the user to reduce the speed of the skate board by depressing the brake depressor with his foot to thereby urge the brake shoes against the rear wheels to reduce the speed of the skate board or bring it to a halt. The user may thereby maintain maneuverability and stability of the skate board and operate it in a safer manner. The curvature of the first portion of the brake arm does not impede the normal pivoting of the rear wheels of the skate board and the entire apparatus does not impede the normal use of the skate board.

Obviously, many modifications and variations of the present invention are possible in the light of the above teachings. It is therefore to be understood that within the scope of the appended claims, the invention may be practiced otherwise than as specifically described.

I claim:

1. A skate board wheel brake assembly for providing a braking force to the rear wheels of a skate board comprising:

a resilient brake arm molded to be integral with said skate board, said brake arm including a first portion formed to be in close proximity to said rear wheels of said skate board, brake shoe means mounted on said first portion of said resilient brake arm adjacent said rear wheels, and said brake arm further including a second extended portion having brake depressor means formed at the end thereof, whereby the depression of said brake depressor means urges said first portion toward said rear wheels to thereby urge said brake shoe means into contact with said rear wheels to thereby provide braking force to said rear wheels.

2. The apparatus as described in claim 1 and wherein said resilient brake arm is formed of plastic.

3. The apparatus as described in claim 2 and wherein said brake shoes are formed of a material which has a hardness than is equal to or less than the hardness of said wheels.

* * * * *